US008266732B1

(12) United States Patent
Wang et al.

(10) Patent No.: US 8,266,732 B1
(45) Date of Patent: Sep. 18, 2012

(54) AUXILIARY SIPHON DEVICE FOR THE TOILET

(75) Inventors: Bing Wang, Xiamen (CN); Rongyu Zhang, Xiamen (CN)

(73) Assignee: Xiamen R&T Plumbing Technology Co., Ltd., Xiamen (CN)

( * ) Notice: Subject to any disclaimer, the term of this patent is extended or adjusted under 35 U.S.C. 154(b) by 0 days.

(21) Appl. No.: 13/241,894

(22) Filed: Sep. 23, 2011

(30) Foreign Application Priority Data

Mar. 25, 2011 (CN) ..... 2011 2 0083179 U

(51) Int. Cl.
*E03D 1/06* (2006.01)

(52) U.S. Cl. ..... 4/368

(58) Field of Classification Search ..... 4/353, 368
See application file for complete search history.

(56) References Cited

U.S. PATENT DOCUMENTS 3,115,148 A * 12/1963 Liijendahl ..... 137/205

FOREIGN PATENT DOCUMENTS

CN 200982017 Y 11/2007

* cited by examiner

*Primary Examiner* — Lori Baker
(74) *Attorney, Agent, or Firm* — Rabin & Berdo, P.C.

(57) ABSTRACT

An auxiliary siphon device for the toilet has: a hollow air container, which is bottom-opened, an abdicating groove in which a drain valve can be installed in is vertically disposed in the sidewall of the air container, said abdicating groove is communicated with the water tank; through holes for water flow are provided in the sidewall of the air container in the lower portion of the abdicating groove; a sealing bottom cover communicated with the bottom of the air container, and a drain valve installing hole is disposed in the sealing bottom cover corresponding to bottom of the abdicating groove; and a connecting tube, the bottom end of which is connected to the trapway of the toilet, and the top end of which is connected to the top of the inside of the air container.

11 Claims, 9 Drawing Sheets

AUXILIARY SIPHON DEVICE FOR THE TOILET

FIELD OF THE INVENTION

The present invention relates to a suction device capable of producing negative pressure by sucking air, more particularly, to auxiliary siphon device for the toilet.

BACKGROUND OF THE INVENTION

CN200982017Y disclosed a water-saving type toilet with pressurized air pipe, the compression system comprising a first cavity for storing water, a second cavity for storing air and an air conduit communicated with the pressurized air pipe and installed inside the second cavity; i.e. the utility model has double cavities, one for storing air, and the other for storing air, the two cavities are separated from the water tank of the toilet, and the water drained out from the drain valve is the water filled inside the two cavities; for better compression effect, the first cavity and the second cavity are needed for bigger volume, so the sectional area of the water tank cooperated with them must be bigger, thus the water tank with smaller sectional area can not be used.

SUMMARY OF THE INVENTION

The primary object of the present invention is to obviate the disadvantages in prior art and provide an auxiliary siphon device for the toilet, which is installed inside a small water tank, when the water level in the small water tank is falling, the device suck out the air between the two traps so that the negative pressure between the two traps is enhanced, thus only small drain water will produce siphon rapidly to let the waste in the toilet drained out rapidly.

The object of the present invention is achieved by providing: An auxiliary siphon device for the toilet, comprising: an air container, which is bottom-opened and hollow-inside, an abdicating groove in which a drain valve can be installed in is vertically disposed in the sidewall of the air container, said abdicating groove is communicated with the water tank. through hole (s) for water flow is/are provided in the sidewall of the air container in the lower portion of the abdicating groove; a sealing bottom cover communicated with the bottom of the air container, a drain valve installing hole is disposed in the sealing bottom cover corresponding to bottom of the abdicating groove; a connecting tube, the bottom end of which is connected to the trapway of the toilet, and the top end is connected to the top of the inside of the air container.

Several locating holes are disposed in the wall of the opening of the air container, the corresponding position of the sealing cover to the locating holes are provided with locating protrudes, the locating protrudes cooperated with the locating holes, thus the opening of the air container is sealingly connected to the bottom cover.

The corresponding position of the sealing bottom cover to the opening of the air container is provided with a pipe hole communicated with the inside of the air container; said pipe hole is used for installing connecting tube to let it installed inside the air container; the rising or falling of the water level in the air container will make the cavity of the air container drain out air or suck in air from outside via the connecting tube.

Said sealing bottom cover are assembled by a separating board clamped with the opening of the bottom of the air container, and a fixation board formed integrated with the bottom of the abdicating groove; the installing hole for the drain valve is disposed in the fixation board, and the corresponding position of the separating board to fixation board is provided with an abdicating opening, the fixation board is cooperated with the abdicating opening. The fixation board of the bottom cover is separated out and one-step mould with the bottom of the abdicating groove of the air container, thus the integer strength of the air container can be enhanced. The fixation board with an abdicating opening formed by the fixation board being separated from the bottom cover, the abdicating opening also enhance the structural strength of the separating board.

The locating protrudes of the sealing bottom cover are fixed on the flanges of the separating board, the separating board is sealingly connected with the bottom of the air container by the clamping between the locating protrudes and the locating holes; said pipe hole is disposed in the separating board; said connecting tube inserted in the pipe holes and is inside the air container, the top end of the connecting tube connected to the op of the air container, the bottom of the connecting tube protruded out from the bottom of the communicating pipe. When the water level of the air container is fall, a negative pressure will formed inside the air container, the connecting tube communicated with the air container will suck air from the siphon tube of the toilet, then the siphon tube will produce an air negative pressure to enhance the pressure difference between the two terminals of the upper trap, i.e. the negative pressure of the siphon tube is rise so that less draining water will produce siphon, thus to achieve water saving.

The top end of the connecting tube is fixed with a plug for adjusting the air flow of the connecting tube, which can control the air sucking speed of the connecting tube from the siphon tube, i.e. the negative pressure formed in the siphon tube is depended on the siphon-forming speed of the trap.

Said connecting tube is disposed outside the air container, the top end of the connecting tube is connected to the top end of the air container; the connecting tube disposed outside the air container make it convenient to adjust the plug on the top end of the connecting tube.

The present invention has the following advantages: the abdicating groove in the sidewall of the air container can be inserted with the drain valve, i.e. the drain valve is surrounded by the air container, the whole abdicating groove is communicated with the water tank, thus another water container is not needed, and the volume of the present invention can be reduced greatly, and can be used in small water tank; when the water levels of the air container is fall, negative pressure will formed in the top portion of the air container so that the air in the siphon tube of the toilet will suck the air in the siphon tube via the connecting tube, and the pressure difference between the two terminals of the upper trap will enhanced, thus the negative pressure of the siphon tube is rise so that less draining water will produce siphon rapidly, and the waste can be drained out rapidly, thus to achieve water saving.

10 air container; 11 cavity; 12 opening; 13 locating hole 14. abdicating groove 15. through hole;

20. bottom cover; 21. fixation board; 211. drain valve installing hole;

22. separating board; 221 locating protrude; 222 abdicating opening; 223 pipe hole;

30. connecting tube; 40 adjusting plug; 50 water tank; 60. inlet valve;

70. drain valve;

80. toilet. 81. upper trap; 82. lower trap; 83. siphon tube; 84. sucktion tube.

DETAILED DESCRIPTION FOR THE PREFERRED EMBODIMENTS

Preferred embodiment of the present invention will be described in detail with reference to the drawings and examples; Understanding that these drawings depict only typical embodiments of the invention and are not therefore to be considered to be limiting of its scope.

Figure 1:
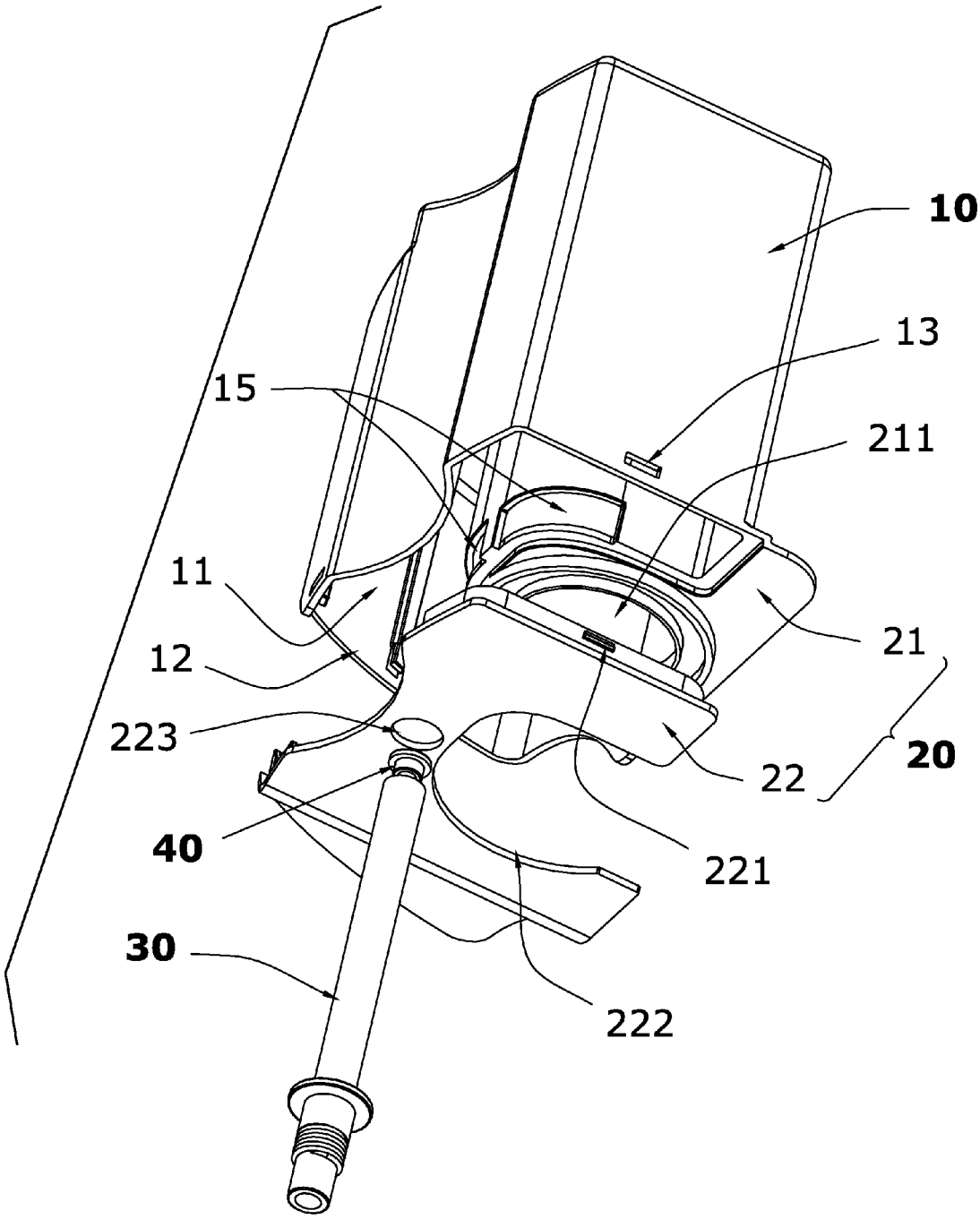
FIG. 1 is an exploded view of the present invention in embodiment 1.
Figure 2:
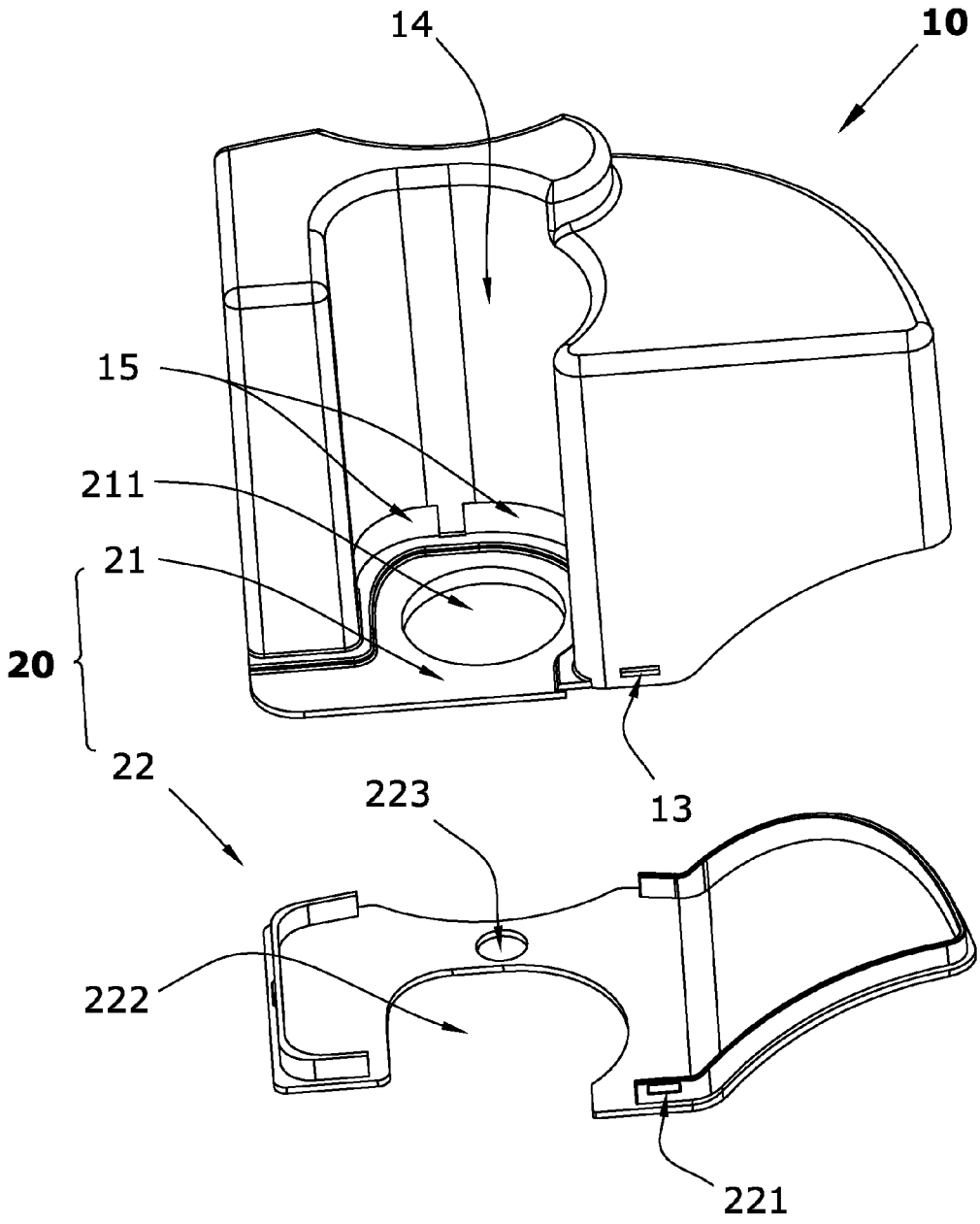
FIG. 2 is an exploded view of the air container and the separating board in embodiment 1.
Figure 3:
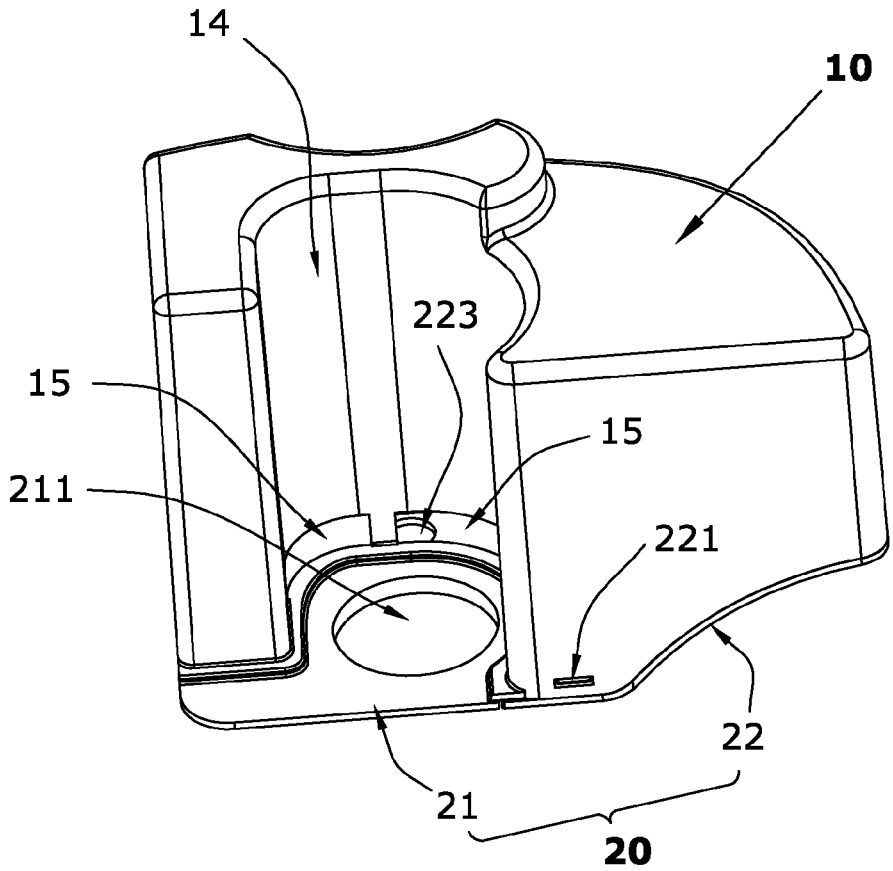
FIG. 3 is a perspective view of the assembled air container and the separating board in FIG. 2.
Figure 4:
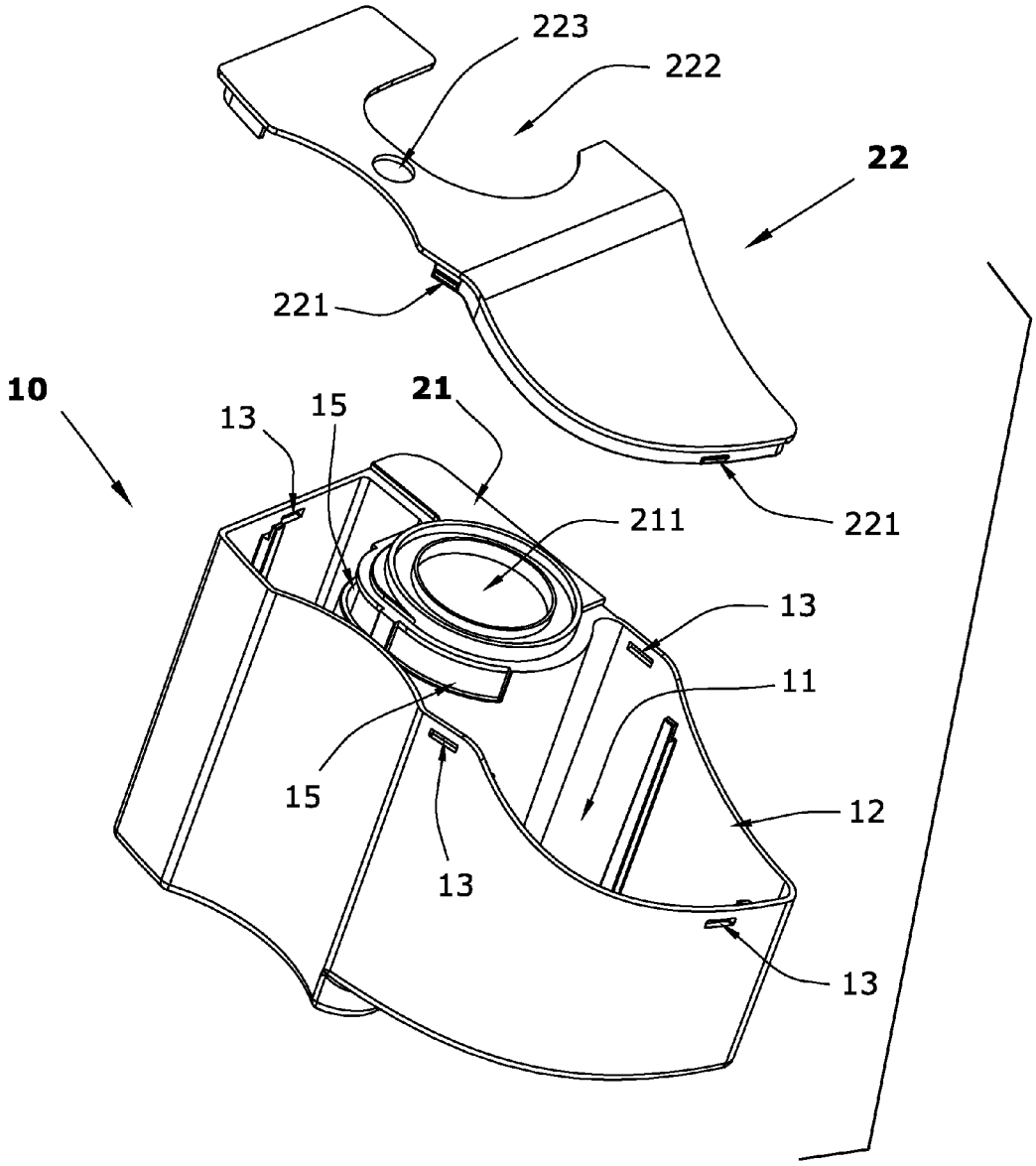
FIG. 4 is another exploded view of the air container and the separating board in embodiment 1.
Figure 5:
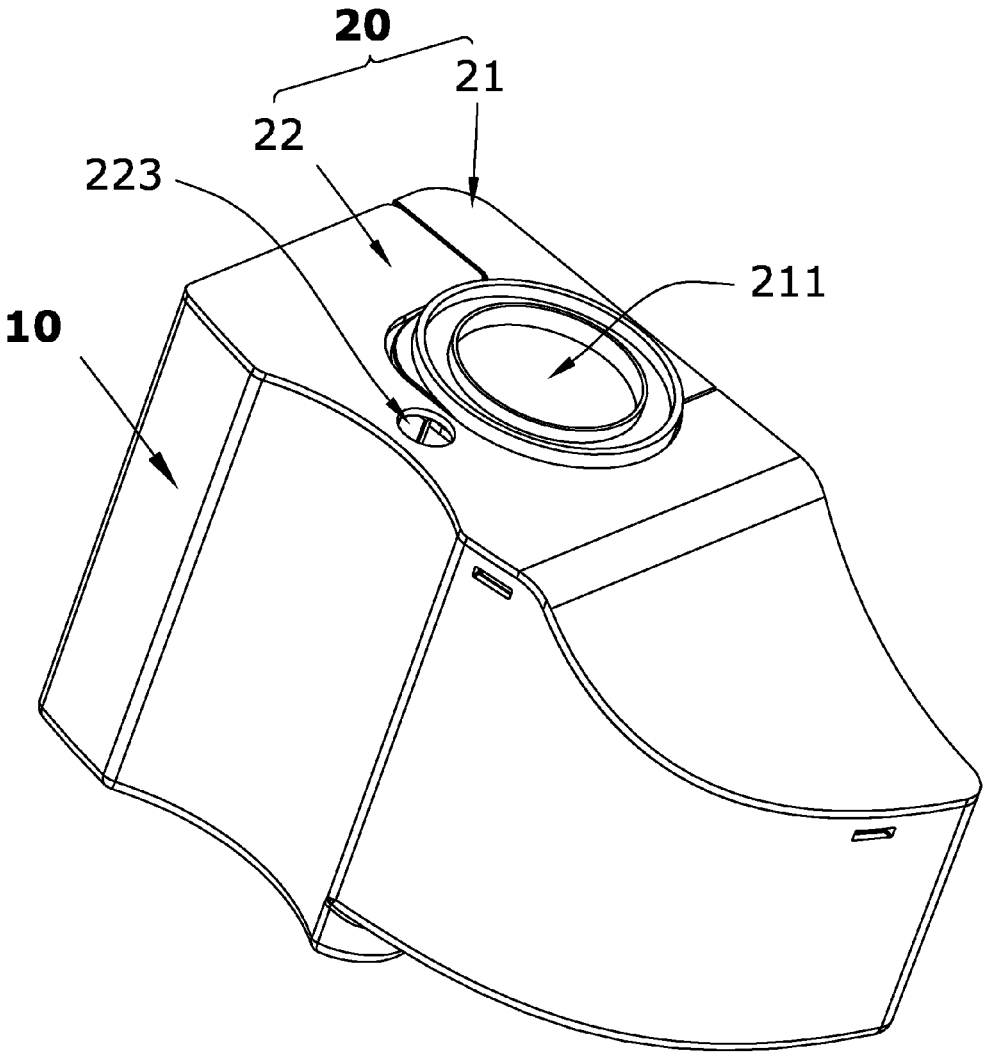
FIG. 5 is another perspective view of the assembled air container and the separating board in FIG. 4.
Figure 7:
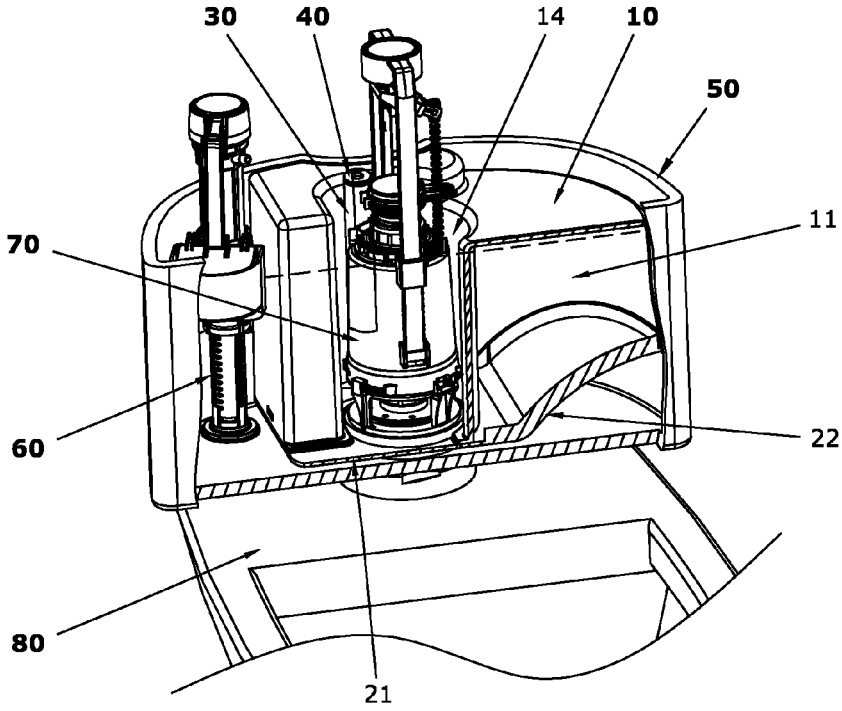
FIG. 7 is a sectional view of the present invention installed inside the small water tank.
Figure 8:
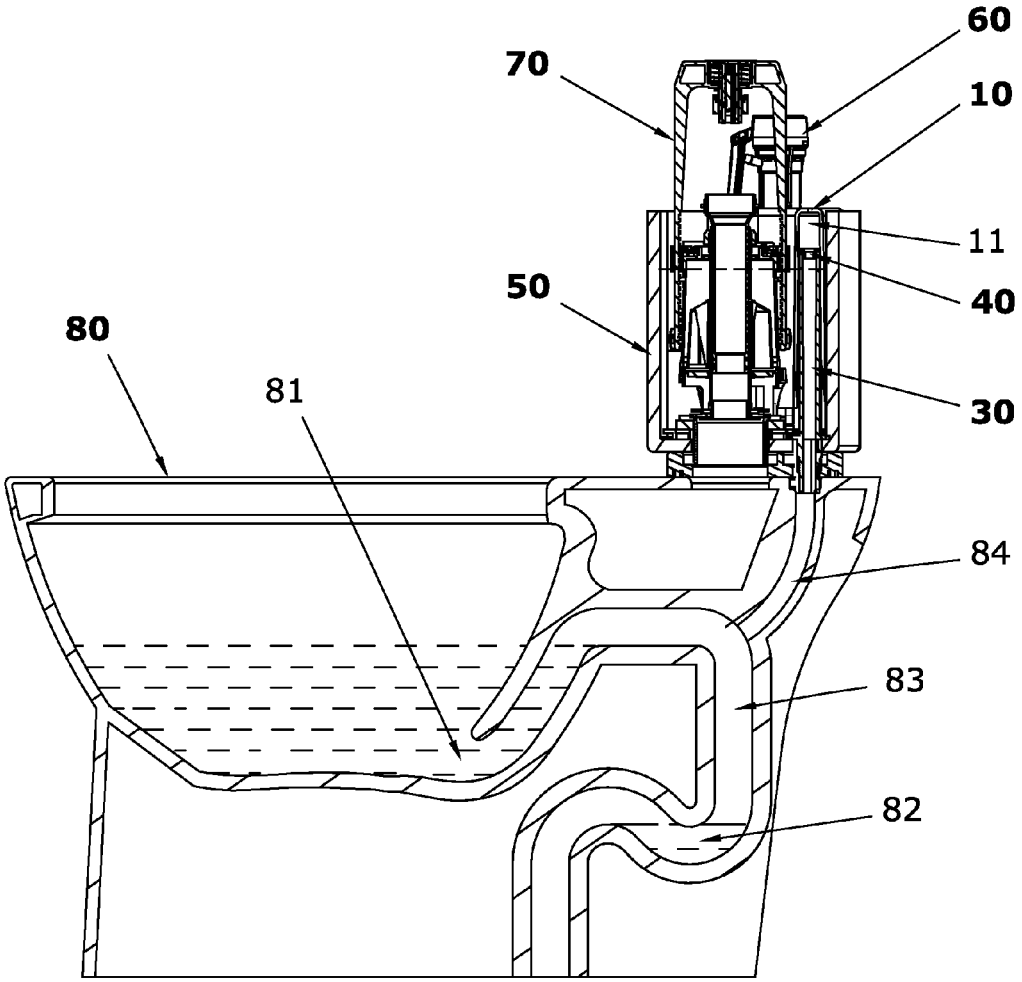
FIG. 8 is a sectional view of the present invention installed inside the double-traps toilet.

Embodiment 1: referring to FIG. 1, an auxiliary siphon device for toilet mainly comprises an air container 10, a bottom cover 20 and a connecting tube 30. referring to FIG. 2 to FIG. 5, the cavity 11 of the air container 10 is a hollow cavity, the bottom of the air container 10 is an opening 12 of the cavity 11, the wall near the opening 12 of the air container 10 is provided with several locating holes 13; an abdicating groove 14 communicated with the water tank 50 is vertically disposed in the sidewall of the air container 10, a drain valve can be installed in the abdicating groove 14, the bottom of the abdicating groove 14 is provided with through holes 15 for water flow, which communicated to the cavity 11 of the air container, the abdicating groove 14 of the side wall and the drain valve installing hole 211; a sealing bottom cover 20 which can clamp with the bottom of the air container 10, the bottom cover 20 comprises a separating board 22 cooperated with the opening 12 in the bottom of the air container 10 and a fixation board 21 integrated with the bottom of the abdicating groove 12, i.e. the fixation board 21 is positioned in the bottom of the abdicating groove 14 and is one-step formed with the air container, the drain valve installing hole 211 is positioned in the fixation board 21; The corresponding position of the separating board 22 to the fixation board 21 is provided with an abdicating opening 222, The corresponding position of the separating board 22 to the opening 12 of the air container 10 is provided with a pipe hole 223 connecting to the cavity 11 of the air container 10, locating protrudes 221 are fixed on the flange of the separating board 22, the separating board 22 is sealingly connected with the bottom of the air container 10 by the clamping between the locating protrudes 221 and the locating holes 13, the fixation board 21 is cooperated with the opening 222 of the separating board 22. Referring to FIG. 1. FIG. 7 and FIG. 8, a connecting tube 30 inserted in the pipe hole 223 is disposed inside the air container 10, its bottom end is connected to the siphon tube of the toilet, and its top end is fixed with a adjusting plug 40 for adjusting the air flow of the connecting tube 30, the top end of the connecting tube 30 is connecting to the top of the air container 10, the working water lever of the air container 10 is not higher than the top of the connecting tube 30 inside the air container 10, and the lower end of the connecting 30 is protruded out from the separating board 22 of the bottom cover 20, thus, the assembly of the present invention is completed. The drain valve can be installed in the abdicating groove 14 of the air container 10, and the whole abdicating groove 14 is communicated with the water tank 50, thus another water container is not needed, and the volume of the present invention can be reduced greatly, and can be used in small water tank 50.

Figure 6:
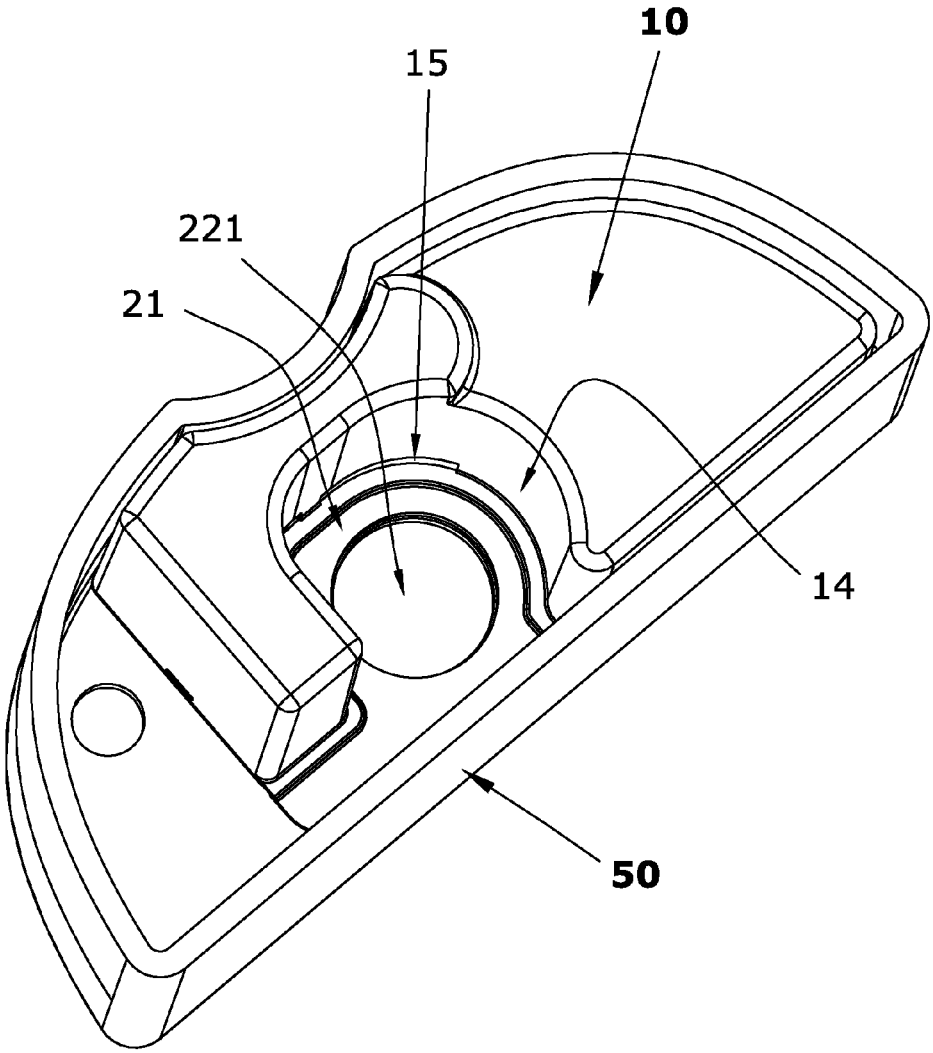
FIG. 6 is a perspective view of the present invention installed inside the small water tank of the toilet in embodiment 1.

Referring to FIG. 6, the present invention is sleeved in the water tank 50 of the upper of the toilet with double traps, then referring to FIG. 7 and FIG. 8, insert the drain valve 70 into the abdicating groove 14, the abdicating groove 14 is communicated with the water tank 50, the installing hole of the water tank 50 and the installing hole 211 in the bottom of the abdicating groove 14 is connected by the drain valve 70, the connecting tube 30 is connected to the sucktion tube 84 of the toilet 80, and the inlet valve 60 is installed inside the water tank 50.

The principle and the process will be more detailedly described in the following description.

Open the inlet valve 60, the water will filled into the water tank 50, as is shown in the FIG. 6 to FIG. 8, the water in the water tank will flow into the air container 10 via the abdicating groove 14 and the hole 15, as the water level in the air container 10 is rise, the air container 10 will compress the air in the cavity 11 of the air container 10, the air then is pressed into the siphon tube 83 between the upper trap 81 and lower trap 82 of the toilet 80 via the connecting tube 30 and the suction tube 84. When the air pressure is rise to a certain point, the air is pressed out to the drain pipe through the lower trap 82, when the water in the water tank 50 is reach to a working level, the water filled into the water tank 50 from the inlet valve 60 is stopped, accordingly, the rise of the water levels of the air container 10 is stopped, and the water level in the cavity 11 of the air container 10 is a little lower than the top of the connecting tube 30.

When the drain valve 70 is opened, the water in the water tank 50 will flush to the toilet 80 through drain valve 70 installed in the hole 211, then the water level in the water tank 50 fell, and the water level in the air container 10 also fell, because the water is flow to toilet 80 via the drain valve 70. The falling water level of the air container 10 make the cavity 11 of the air container 10 suck the air in the siphon tube 83 between the upper trap 81 and lower trap 82 through the plug 40, connecting 30 and suction tube 84 of the toilet 60, thus a negative pressure is formed in the siphon tube 83, and siphon will be more quickly formed by the negative pressure. Compared to prior toilet in background, if the present device is applied, a negative pressure will be take to the siphon tube 83 when flush the toilet when the small water tank 50 is flushing to the toilet 80, thus less water will bring a big suction power and form siphon more quickly in the trap of the toilet 80, the waste in the toilet 80 will be quickly drained out to the drain pipe connected to the toilet 80.

Figure 9:
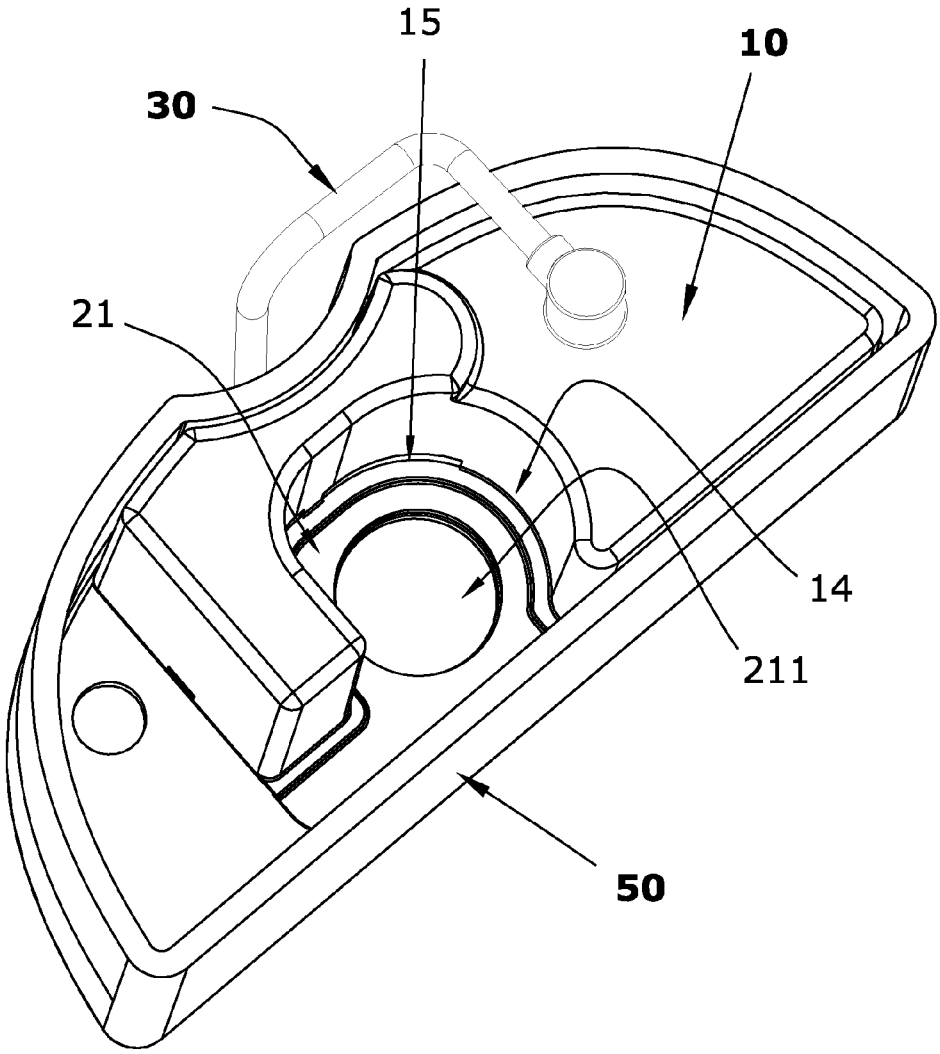
FIG. 9 is a perspective view of the present invention installed inside the small water tank of the toilet in embodiment 2.

Embodiment 2: referring to FIG. 9, the difference of the embodiment 2 to embodiment 1 is that: in embodiment 1, the connecting tube 30 is mounted in the air container 10 to let the structure to be compact; in this embodiment the connecting tube 30 is mounted outside the air container 10, the top end of the connecting tube 30 is connected to the top of the air container 10 and communicated to the cavity 11, the plug 40 (not shown) on the top end of the connecting tube 30 thus can be conveniently be adjusted to avoid that in each time the air flow in the connecting tube 30 needed to be adjusted, the air container 10 must be disassembled from the water tank 50; in this embodiment the separating board 22 and the fixation board 21 can be integrated to be the bottom cover 20, and the cover 20 is not provided with hole 223 for inserting the connecting tube 30. The other connecting structure, principle and process are the same as embodiment 1.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with detailed description, but rather by the claims appended hereto.

What is claimed is:

1. An auxiliary siphon device for a toilet, comprising:

an air container configured to be disposed in a water tank of the toilet, the air container having an opening formed on a bottom thereof, an abdicating groove defined by a sidewall of the air container for accommodating a drain valve of the toilet, said abdicating groove being in communication with the water tank when the air container is disposed in the water tank, and through holes formed on the sidewall of the air container in a lower portion of the abdicating groove for connecting the abdicating groove and an interior of the air container;

a sealing bottom cover configured to cover the opening on the bottom of the air container, a drain valve installing hole being formed in the sealing bottom cover as an opening of the abdicating groove; and a connecting tube, a bottom end of which is configured to connect to a trapway of the toilet, and a top end thereof being configured to connect to a top of the interior of the air container.

2. The auxiliary siphon device for the toilet according to claim 1, further comprising a plurality of locating holes disposed on sidewalls of the air container, and a plurality of locating protrudes, each corresponding to one of the plurality of locating holes, formed on the sealing bottom cover, for securing the sealing bottom cover to the air container.

3. The auxiliary siphon device for the toilet according to claim 1, further comprising a pipe hole formed in the sealing bottom cover, so that the connecting tube disposed thereto is in communication with the interior of the air container.

4. The auxiliary siphon device for the toilet according to claim 1, wherein said sealing bottom cover includes a separating board for covering the opening of the bottom of the air container, and a fixation board integrated with the bottom of the air container and partially covering the abdicating groove, the separating and fixation boards respectively having an abdicating opening and an installing hole formed therein that correspond to each other for accommodating the drain valve.

5. The auxiliary siphon device for the toilet according to claim 4, further comprising a plurality of locating protrudes disposed on flanges of the separating board, to sealingly connect the separating board to the bottom of the air container by clamping the locating protrudes to the locating holes formed on the bottom of the air container; and a pipe hole is disposed in the separating board, said connecting tube being inserted in the pipe hole and being disposed inside the air container, the top end of the connecting tube being connected to the top of the air container, the bottom of the connecting tube protruding out from the bottom of a communicating pipe.

6. The auxiliary siphon device for the toilet according to claim 1, wherein the top end of the connecting tube is fixed with a plug for adjusting an air flow of the connecting tube.

7. The auxiliary siphon device for the toilet according to claim 1, wherein said connecting tube is disposed outside the air container, the top end of the connecting tube is connected to a top end of the air container.

8. The auxiliary siphon device for the toilet according to claim 2, wherein said sealing bottom cover includes a separating board for covering the opening of the bottom of the air container, and a fixation board integrated with the bottom of the air container and partially covering the abdicating groove, the separating and fixation boards respectively having an abdicating opening and an installing hole formed therein that correspond to each other for accommodating the drain valve.

9. The auxiliary siphon device for the toilet according to claim 3, wherein said sealing bottom cover includes a separating board for covering the opening of the bottom of the air container, and a fixation board integrated with the bottom of the air container and partially covering the abdicating groove, the separating and fixation boards respectively having an abdicating opening and an installing hole formed therein that correspond to each other for accommodating the drain valve.

10. The auxiliary siphon device for the toilet according to claim 8, further comprising a plurality of locating protrudes disposed on flanges of the separating board, to sealingly connect the separating board to the bottom of the air container by clamping the locating protrudes to the locating holes formed on the bottom of the air container; and a pipe hole is disposed in the separating board, said connecting tube being inserted in the pipe hole and being disposed inside the air container, the top end of the connecting tube being connected to the top of the air container, the bottom of the connecting tube protruding out from the bottom of a communicating pipe.

11. The auxiliary siphon device for the toilet according to claim 9, further comprising a plurality of locating protrudes disposed on flanges of the separating board, to sealingly connect the separating board to the bottom of the air container by clamping the locating protrudes to the locating holes formed on the bottom of the air container; and a pipe hole is disposed in the separating board, said connecting tube being inserted in the pipe hole and being disposed inside the air container, the top end of the connecting tube being connected to the top of the air container, the bottom of the connecting tube protruding out from the bottom of a communicating pipe.

* * * * *